US009382752B1

(12) United States Patent
Zubay

(10) Patent No.: US 9,382,752 B1
(45) Date of Patent: Jul. 5, 2016

(54) VERTICAL ROLL DOWN DEVICE WEIGHT BAR CONTAINING A SELF-ADJUSTING BOTTOM BARRIER BLADE FOR VARIABLE PITCHED OR CONTOURED SURFACES

(71) Applicant: Kenneth Zubay, Boca Raton, FL (US)

(72) Inventor: Kenneth Zubay, Boca Raton, FL (US)

( * ) Notice: Subject to any disclaimer, the term of this patent is extended or adjusted under 35 U.S.C. 154(b) by 0 days.

(21) Appl. No.: 14/662,774

(22) Filed: Mar. 19, 2015

Related U.S. Application Data

(60) Provisional application No. 61/955,313, filed on Mar. 19, 2014.

(51) Int. Cl.
*E06B 7/18* (2006.01)

(52) U.S. Cl.
CPC ..... *E06B 7/18* (2013.01)

(58) Field of Classification Search
CPC ..... E06B 7/18
USPC ..... 160/40, 41, 369, 371; 49/315; 277/921
See application file for complete search history.

(56) References Cited

U.S. PATENT DOCUMENTS 3,263,366 A * 8/1966 Woloohojian ..... E06B 7/18 49/314
3,453,780 A * 7/1969 Thompson ..... E06B 7/18 49/482.1
3,755,968 A * 9/1973 Williams ..... E06B 7/18 160/40
4,320,793 A 3/1982 Lindbergh
4,413,446 A * 11/1983 Dittrich ..... E06B 7/18 49/470
4,716,683 A * 1/1988 Minter ..... E06B 7/22 49/479.1
5,445,209 A * 8/1995 Lichy ..... E06B 9/13 160/273.1
5,447,187 A * 9/1995 Gustafson ..... E06B 9/17007 160/40
6,622,431 B1 9/2003 Simons

* cited by examiner

*Primary Examiner* — David Purol
(74) *Attorney, Agent, or Firm* — Malin Haley DiMaggio & Bowen, P.A.

(57) ABSTRACT

A roll down movable vertical screen, panel or shutter system (such as used for protecting against insects, solar wind, hurricanes, rain or providing for privacy and security having a bottom edge-weight bar and self-adjusting blade that automatically adjusts to variable pitched surfaces to seal the gap resulting from a roll down screen or shutter's bottom horizontal weight bar and a floor surface that is contoured or pitched in a non-horizontal direction running parallel to the direction of the weight bar. The self-adjusting weight bar for variable pitched surfaces generally including: a weight bar body, a self-adjusting blade, customizable attachment point, variable weights, and anti-warping stiffeners. These elements are to be found as the lowest element of a roll down screen or shutter. The extended elongated weight bar is attached at the bottom edge of a screen and includes a hollow chamber that receives an L-shaped blade that is movably mounted within the hollow chamber so that the blade can conform to the tilt angle or compound contour of the floor.

9 Claims, 11 Drawing Sheets

VERTICAL ROLL DOWN DEVICE WEIGHT BAR CONTAINING A SELF-ADJUSTING BOTTOM BARRIER BLADE FOR VARIABLE PITCHED OR CONTOURED SURFACES

CROSS REFERENCE TO RELATED APPLICATIONS

This application claims the benefit of provisional U.S. Patent Application No. 61/955,313, filed on Mar. 19, 2014.

BACKGROUND OF THE INVENTION

The present invention relates generally to vertically movable roll down screens, shutters and doors having self-adjusting weight bar bottom blades that contact non-level floors and more specifically to a self-adjusting bottom weight bar for vertical screens (i.e. insect, solar, hurricane, privacy and security) for variable pitched surfaces or contours for self-sealing the gap resulting from a roll down screen or shutter's bottom horizontal weight bar and a floor surface that is variable contoured or pitched in a non-horizontal direction running parallel to the direction of the weight bar.

BRIEF SUMMARY OF THE INVENTION

A roll down vertical device weight bar which includes a weight bar body and a self-adjusting blade to provide a barrier below the weight bar. Example: used for insect screens to restrict insects and dust on a pitched floor surface. These elements are to be found at the lowest element of a roll down screen or shutter. A roll down screen or shutter comprises the following components: a) two vertical side tracks or guides that typically extend from a floor to the top of the opening. Spanning the top of the opening is typically found a metal hood that contains a metal reel upon which is wound either a screen or shutter. The reel when turned, either extends or retracts the screen or shutter toward the hood. When the screen or shutter is extended, the screen or shutter is pulled downwardly by a weighted weight bar mounted along the bottom edge of the screen.

The sides of the screen or shutter are always held within the two vertical side tracks or guides as it moves upward and downward. When the screen or shutter is retracted, the screen and weight bar are raised upwardly back toward the hood. This invention replaces the normal weight bar. Normal weight bars are not adjustable and are generally set to always be horizontal. Floors and other outdoor surfaces are typically not horizontal, but are sloped or contoured to allow for water runoff. Normal weight bars stop their decent at the highest points of the floors leaving a triangular opening between the weight bar and the floor if the floor is sloped from one side, or the weight bar will be held at the highest point if the floor surface is contoured such as being raised higher in the center of the screen leaving both sides of the screen not touching the floor. These openings allows insects to invade the enclosed area. This invention automatically self-adjusts to seal the entire opening. In the case of an insect screen, leaving the enclosed area secured against insects which was the purpose of installing the insect screen in the first place. In the case of an insect screen.

An object of the invention is to provide a self-adjusting weight bar and blade for variable pitched or contoured surfaces for self-sealing the gap resulting from a roll down screen or shutter's bottom horizontal weight bar and a floor surface that is pitched in a non-horizontal direction running parallel to the direction of the weight bar or to fill in the gaps caused by a contoured surface such as poorly laid tiles.

Another object of the invention is to provide a stiffening mechanism that allows the weight bar to remain rigid and in horizontal alignment with the side tracks or side guides.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of this application

PREFERRED EMBODIMENTS OF THE INVENTION

Figure 1:
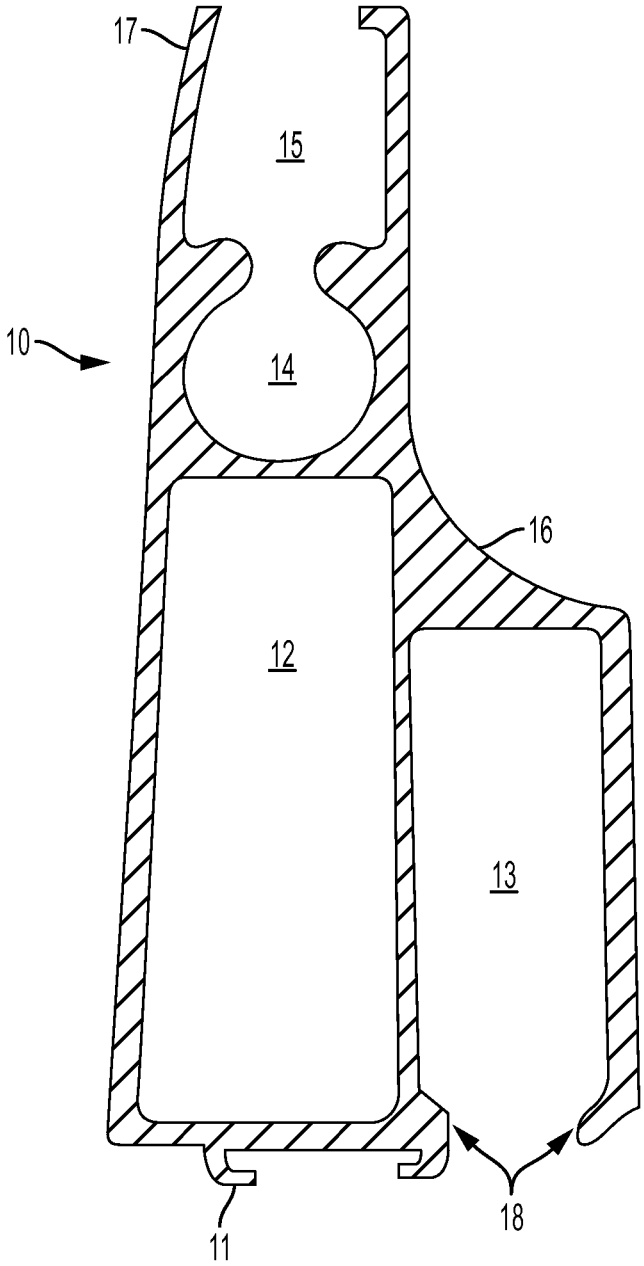
FIG. 1 shows an end or side elevation view in cross-section of the weight bar body that is attachable to the bottom edge of the vertically positionable screen that engages a floor surface in the down position.
Figure 2:
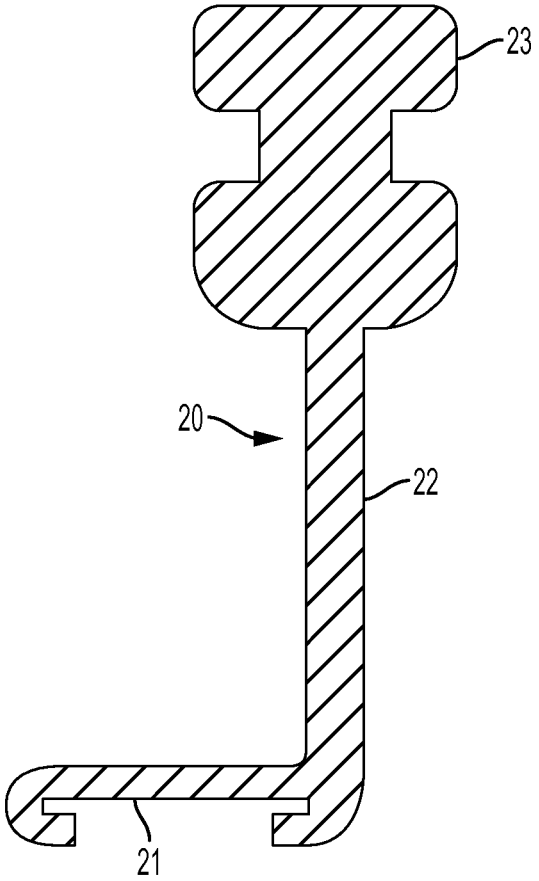
FIG. 2 shows a side elevation cross-sectional view of the blade that is movably attachable to the weight bar body shown in FIG. 1.
Figure 3:
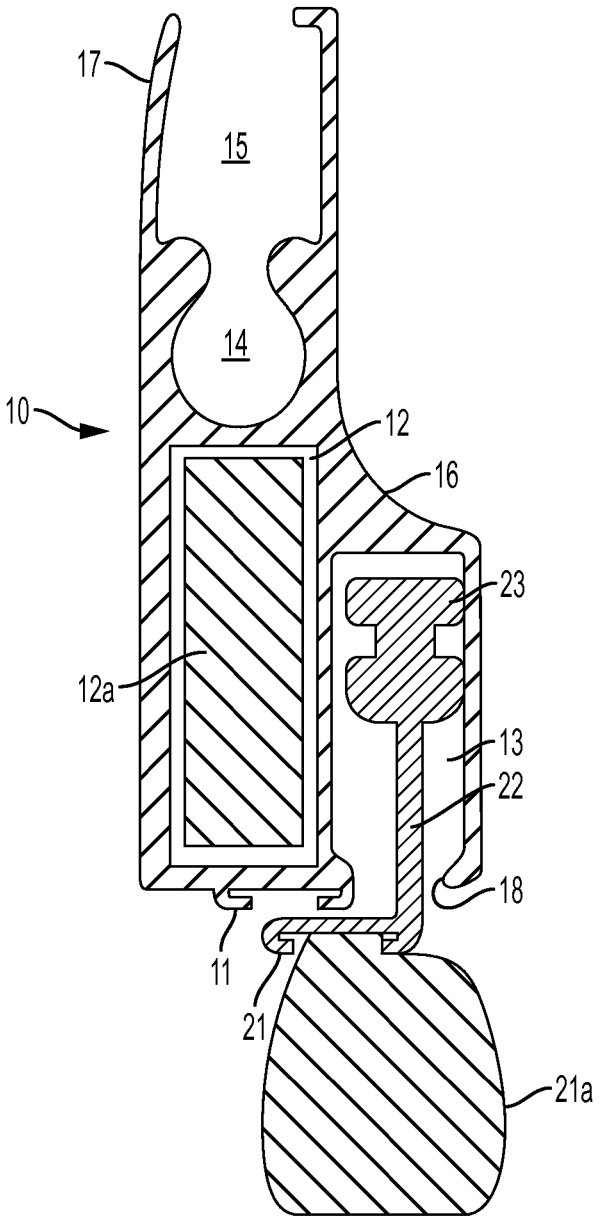
FIG. 3 shows a side elevation view in cross-section of the weight bar body shown in FIG. 1, the blade shown in FIG. 2 movably attached to the weight bar body, a weight mounted in said weight bar body, and an insect barrier that engages a floor.
Figure 4:
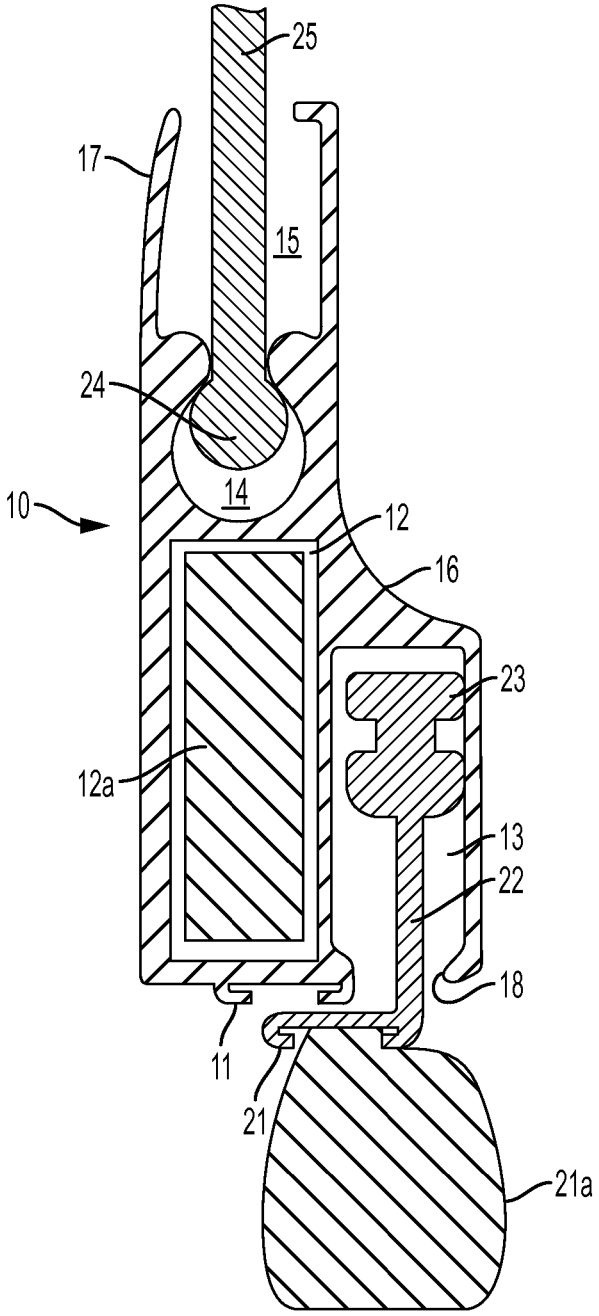
FIG. 4 shows a side elevation view in cross-section of the device as shown in FIG. 3 that includes a view of the base of a screen and screen connector partially cutaway and attached to the weight bar body.

FIG. 1 is an end elevation view of the present invention. The weight bar body 10 is shown in cross-section having a molded weather strip holder 11 for attaching a weather strip (such as a pliable brush/bulb/fin) that will make sealable contact with a surface such as a floor, sill or outdoor surface. Note the weather strip does not directly attach to the weight bar body 10 if the self-adjusting blade 20 shown in FIG. 2 is used. The enclosed weight chamber 12 receives an elongated weight (not shown in FIG. 1). The partially enclosed blade chamber 13 is used to hold the self-adjusting blade 20 in FIG. 2. The attachment chamber 14 is used to attach the bottom of the screen or shutter by a material that can fit into the attachment chamber 14. This attachment can be of any substance such as: rope, chain, keder, zipper, formed extrusion, fiberglass or aluminum rod or some other type of device with some other type of attachment mechanism. The hem chamber 15 is used to hide any required screen stitching or welded screen side hems. The curved brace 16 is used for lateral strength to reduce bending. The deflector 17 is used to deflect projecting obstacles that might be extending from the surface to which the screen or shutter is attached such as a soffit edge, plaster ridge or back of the hood restricting the movement of the weight bar as the weight bar body 10 moves in an upward vertical direction.

The right side of the device shown in FIG. 1 is considered the front of the weight bar body 10. The offset placement of attachment chamber 12 insures that the back side of weight bar body 10 will have a small wall clearance when the weight bar body 10 is moved up and down within the side tracks.

The positioning of the attachment chamber 14 directly above the weight chamber 12 insures that the entire weight bar body 10 will move vertically in a straight orientation to the side tracks or side guides.

The weight chamber 12 is also used to attach the weight bar body 10 end guides (not shown). The end guides extend from each side of the weight chamber 12 to the side track that are used to further align the weight bar to the side tracks and maintain a horizontal spacing between the side tracks. The open ends of the weight chamber 12 are sealed after the weight has been inserted to prevent moisture possible rusting and possible corrosion caused by two dissimilar metals being in contact in a possible salt air environment typically found along ocean coasts.

FIG. 2 is an end elevation view of the self-adjustable blade 20 that is moveable mounted in the blade chamber 13.

The weather strip holder 21 is shown to receive a flexible weather strip 21*a* such as a brush/bulb/fin that makes physical contact with the floor surface and conforms to that surface so that there is no open space with the floor below the weight bar body.

The blade 22 is used to hold the offset weather strip holder 21. The offset on shaft 22 is to allow the weather strip 23 to engage a non-level floor or outdoor surface. The blade guide 23 is smaller in diameter than the attachment chamber 13 to allow free up and down movement of the blade relative to the weight bar body.

Overview

FIGS. 1-13 show the screen segments, weight bar body, weights, self-adjusting blade and weather seal devices. The screen is always held within the two vertical side tracks or guides. When the screen or shutter is retracted, the screen and weight bar are raised upward toward the hood. This invention replaces the normal weight bar. Normal weight bars are not adjustable and are generally set to always be horizontal. Floors are typically not horizontal, but are sloped to allow for water runoff. Normal weight bars will stop their decent at the highest point of the floor leaving openings between the weight bar and the floor. In the case of an insect screen, the opening allows insects to invade the enclosed area. This invention will automatically self-adjust to seal the resulting floor/weight bar openings.

Weight Bar Body

FIGS. 1 and 3-9 describe the weight bar body. The weight bar body 10 extends the full width of the roll down screen or shutter and is attached to the bottom of the roll down screen or shutter. The weight bar body 10 is comprised of several chambers: a) the attachment chamber 14 used to attach to the bottom of a device such as a roll down screen or shutter 14 and b) The weight chamber 12 which contains a heavy substance such as an iron bar to assist the screen or shutter in unrolling from the storage reel, c) the blade chamber 13 that contains the self-adjusting blade 20 that adjusts when the blade seal comes in contact with another surface such as a floor or sill, d) a weather strip holder 11 and 21 that are capable of attaching a flexible weather strip (such as a brush, rubber bulb, plastic fin or other materials) that is pliable enough to fill in a variable height void caused by the meeting of a horizontal bar and a sloped floor surface.

The weight bar body 10 also has the following components: a) a curved deflector 17 that allows the weight bar body 10 to smoothly pass obstacles that might otherwise stop the upward movement. This deflector 17 also will also guide the weight bar body 10 to possibly retract into the screen's hood to reduce the amount of the weight bar that shows below the hood cover when the screen is fully retracted, b) a hem chamber 15 that is used as a visual enhancement to hide a screen's stitched or welded hem, c) a curved brace 16 that is formed into the weight bar body to reinforce the weight bar body 10 so that it does not bend during a strong wind.

The purpose of the weight bar body 10 is to provide an element for pulling the screen down as the screen is unwound from its storage reel. As the screen is lowered, the screen typically comes to rest on a solid surface such as a floor or sill. In addition to acting as a weight, this weight bar body 10 is also used to seal the area between the weight bar and the solid surface. Typically, the floor is not 100% level because floors are designed with a slight pitch so that rain water will run off the floor. The screens are generally installed near the outside edge of the floor. This is where the pitch is the greatest.

A typical weight bar cannot be adjusted to match the slope of the floor surface so the installer has two choices: ignore any resulting gaps between the floor and weight bar or permanently angle the weight bar so that it will match the floor surface. Both solutions have objections. In the case of always having a horizontal weight bar, gaps will appear under the weight bar that will allow insects to enter the enclosed area. In the case of the permanently angled weight bar, the floor gap will be sealed, but at any other distance from the floor, the weight bar will remain angled and when contiguous to other screens provides an unpleasant stair step appearance.

This weight bar body 10 and blade are designed to automatically adjust and seal the typical pitch of the floor.

The weight bar body 10 is the main structure that contains various areas (chambers) and anchor points that join and contain the other required components. The weight bar body 10 is attached and runs the complete width of a roll down (movable) screen or shutter. The weight bar body 10 and its attachments always move with the screen when the screen is being raised or lowered.

The front side of the weight bar body 10 protrudes in front of the side tracks. The rear side of the weight bar body 10 is recessed within the thickness of the side tracks. This recess allows the weight bar body 10 to move up and down without coming in direct contact with the surface where the tracks are attached.

The weight bar body 10 contains several chambers: weight chamber 12 is used to hold a heavy material such as a steel bar, the blade chamber 13 is used to hold the optional self-adjusting blade 20, the attachment chamber 14 is used for connecting to the screen or shutter, and the hem chamber 15 is used to provide a visual barrier to hide the screen's sewn or welded hem.

The weight bar body 10 also contains several specialized components:

The weather strip holder 11 is used to attach a weather strip type of material that is soft or pliable enough to provide a seal between the weight bar body 10 and the floor.

The rear top deflector 17 is used to shift the weight bar body 10 toward the front of the screen or shutter if an object is encountered while the weight bar is moving in an upward direction. This deflection allows the weight bar body 10 to avoid becoming hung up on extended surfaces such as soffit corners. It also will guide the weight bar body 10 into the screen's hood or soffit.

The molded curved brace 16 is used to add horizontal strength to the weight bar body 10.

The restriction 18 is the bottom opening located at the base of the blade chamber 13 that keeps the self-adjusting blade 20 from falling out of the bottom of the weight bar body 10.

The weight bar body 10 can be configured with and without the optional self-adjusting blade 20. When it is configured without the self-adjusting blade 20, the weather strip is attached to the weather strip holder 11. This configuration would only be used if the floor is horizontal and aligned with the weight bar body 10 requiring only the weather strip to seal the area between the weight bar and the floor.

Another more typical type of configuration is when the floor is pitched or contoured and the vertical distance between the floor and the weight bar body 10 varies from one along the length of the weight bar. In this configuration, the self-adjusting blade 20 will be installed in the blade chamber 13. The self-adjusting blade 20 comes to rest on the floor at the same angle of the floor, there by sealing the weight bar to the floor using the weather strip.

Another variable is the amount of weight that is loaded into the weight chamber 12. For example: if a steel bar were to be used, segments could be distributed within the weight chamber 13 to provide just enough weight where required. The weight chamber 13 ends are sealed during the manufacturing final assembly process so that water does not enter causing rust.

Self-Adjusting Blade

FIGS. 2-10 show the self-adjusting blade and weight bar body used with a vertical movable screen or door to correct for un-level floors and outdoor surfaces. This self-adjusting blade 20 moves freely up and down within the blade chamber 13. The self-adjusting blade 20 is held in place by the restriction 18 located at the bottom of the blade chamber 13. The restriction 18 has an opening that is narrower than the widest part of the guide 23 portion of the self-adjusting blade 20.

The blade 22 has a lower end that is offset towards the center of the weight bar body 10. The offset end contains a weather strip holder 21 similar to the weather strip holder 11 found on the bottom of the weight bar body 10. The weather strip holder 21 serves the same purpose as the weather strip holder 11.

At any one time, only one weather strip holder will be used. If the self-adjusting blade 20 is part of the configuration, the weather strip will be attached to it. If the self-adjusting blade 20 is not part of the configuration, the weather strip will be attached to the weather strip holder 11.

The self-adjusting blade 20 is comprised of several elements: guide 23, blade 22 and weather strip holder 21 and weather strip 21*a*.

The guide 23 is used to keep the blade 22 in a vertical orientation to the weight bar body 10 and the guide 23 also retains the blade 22 within the weight bar body 10. The guide (because of its shape) also keeps the individual segments (of a segmented blade) in relative horizontal alignment with each other within the guide chamber. The guide also allows the adjacent segments to freely move without overlapping and possibly restricting each other while assuming the required sealing or un-sealing positions. The lack of close tolerances between the segments and the lack of individually fastened segments to its holder provides operational reliability from otherwise outside contaminants such as sand, dirt, and debris commonly found on a floor.

The blade 22 extends downward from the guide 23. The blade 22 is formed so that the lower end extends toward the center of the weight bar body 10. Attached to the other side of the blade 22 is the weather strip holder 21. The weather strip holder 21 holds a flexible material that is used to seal the space between the weight bar body 10 and floor.

The self-adjusting blade 20 automatically adjusts to the same angle as the floor. This allows the weather strip to seal the space (without gaps) between the floor and the weight bar body 10. If the self-adjusting blade 20 encounters an object on the floor or if it encounters a sloped floor, the blade 20 lower and tilt one or several blade 22 segments 20*a*, 20*b*, and 20*c* so as to most effectively seal the space between the floor and the weight bar body 10.

The self-adjusting blade 20 can be omitted from the configuration if the floor is parallel and horizontal to the weight bar body 10.

Any number and kinds of weather strips 21*a* may be attached to the weather strip holder 21 such as brushes or fiber flexible soft bristles or felt like material.

The self-adjusting blade chamber 13 and blade 20 can also be constructed as a stand-alone component that can be either permanent or temporally attached to another existing device, there-by retro-fitting that device with the self-adjusting blade capability.

Connections of Main Elements and Sub-Elements of Invention

FIGS. 1-10 show the structure and connecting elements of the basic invention.

The weight bar body 10 is the central element to which everything else is either attached or is inserted. The weight bar body 10 attaches to the bottom of whatever item the weight bar body 10 is functioning as the lowest element.

The weight bar body 10 is used to provide structure, cosmetic, sealing and weight functions.

For structure, the weight bar body 10 is constructed from either extruded materials or built up elements that provide the same functions. The structure is formed so that the body resists bending, water intrusion into the weight chamber 12, provides a means of attaching itself as the bottom element of another device, and provides a means of holding self-adjusting blade 20. The weight bar body 10 also has a designed in deflector 17 that is used to allow the weight bar body 10 to slide past items protruding from the wall on which the shutter or screen is mounted. The deflector 17 is also used to assist the weight bar body 10 in retracting into a storage area such as a hood or soffit. The self-adjusting blade 20 is also extruded or fashioned into the same or similar physical profile.

For cosmetic, the weight bar body 10, is designed with a hem chamber 15 that hides the lower edge of a welded or sewn seam or hem or shutter attachment blade. This provides a very clean, uncluttered looking screen or shutter. The weight bar body 10 also is available in multiple colors by means of paint, powder coating or material selection. The colored or uncolored protection coating is used to make the weight bar body 10 more visually attractive and to provide a degree of weather protection. The self-adjusting blade 20 is also available in multiple colors to blend in or to contrast with the weight bar body 10.

For sealing, both the weight bar body 10 and self-adjusting blade 20 have a weather strip holder 11 attached to its bottom. This holds a flexible substance such as a pliable tube, brush or fin that will deform to in order to provide a seal with the floor or other surface that is below the weight bar body 10.

For weight, the weight bar body 10 can accept any form of heavy material that can conform with the dimensions of the weight chamber 12. The amount of weight is variable based upon the application and needs. The weight can be placed and held anywhere within the weight chamber 12 when it is combined with some type of internal spacer.

The self-adjusting blade 20 is inserted into the blade chamber 13 such that the weather strip holder 21 is centered under the weight bar body 10.

Figure 5:
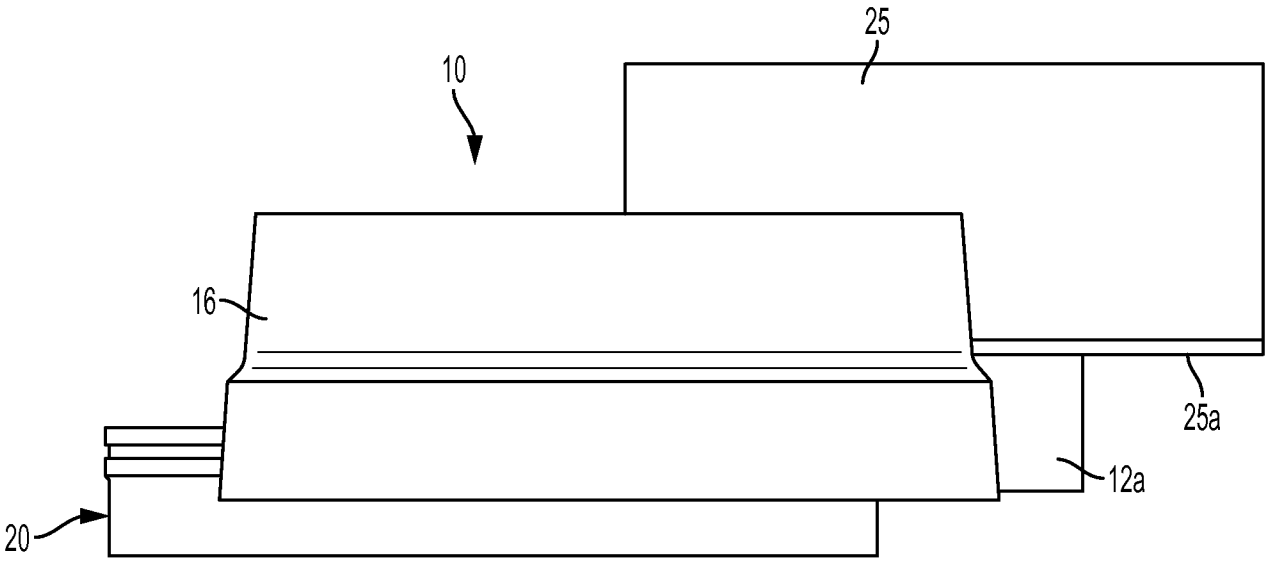
FIG. 5 shows a front elevation view of segments of the screen, weight bar body, the weight, and the self-adjusting blade spaced apart laterally for illustration purposes.

FIG. 5 shows a front elevation view of the primary elements of the invention for illustration purposes. The weight bar body 10 is shown that includes the curved surface 16. The screen is represented by rectangle 25 as being connected into the top of the weight bar by a screen attachment 25*a*. The adjustable blade 20 is shown partially extending from one side of the weight bar body 10 and partially inside the bottom portion of the weight bar body. A weight 12*a* is shown extending out of the base of the weight bar body 10.

Figure 6:
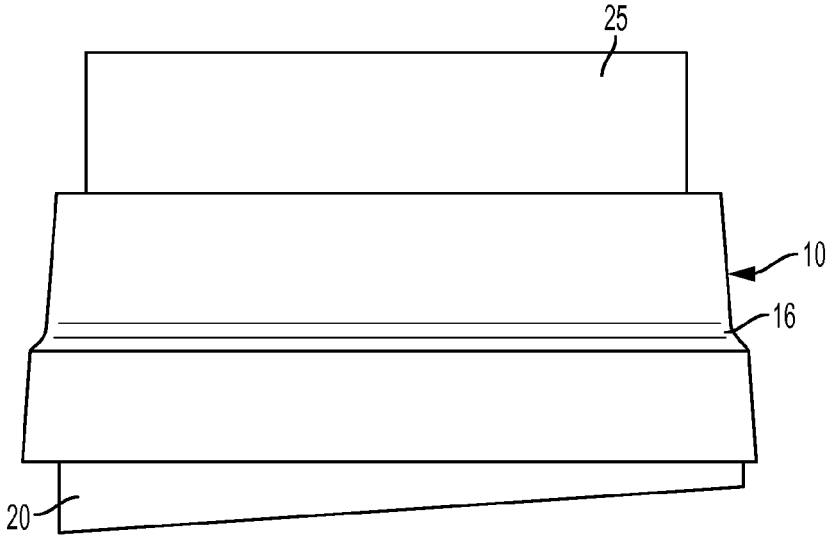
FIG. 6 shows a front elevation view of segments of the screen, the weight bar body, and the self-adjusting blade shown at an angle below the weight bar body for illustration purposes.

FIG. 6 shows the weight bar body 10 and the curved front portion 16. The adjustable blade 20 (in the case of a single blade) is shown tilted at an angle that would represent a sloping floor in which the adjustable blade 20 because of its mobile arrangement inside the weight bar body 10 is able to compensate when the blade contacts a floor to fill in any space between the weight bar body structure and housing and a floor that is not level using the adjustable blade 20. In the case of a multiple segmented blade, the blade would follow the contour of the floor surface resulting in some segments being retracted and other being extended from the blade chamber. Additionally, because the blade segments are freely held within the confines of the blade chamber 13 and the segments are not physically attached or linked together other than by relative horizontal position due to the blade guide 23, each blade segment can individually tilt to either side, slide up or slide down to follow the floor's contour.

Figure 7:
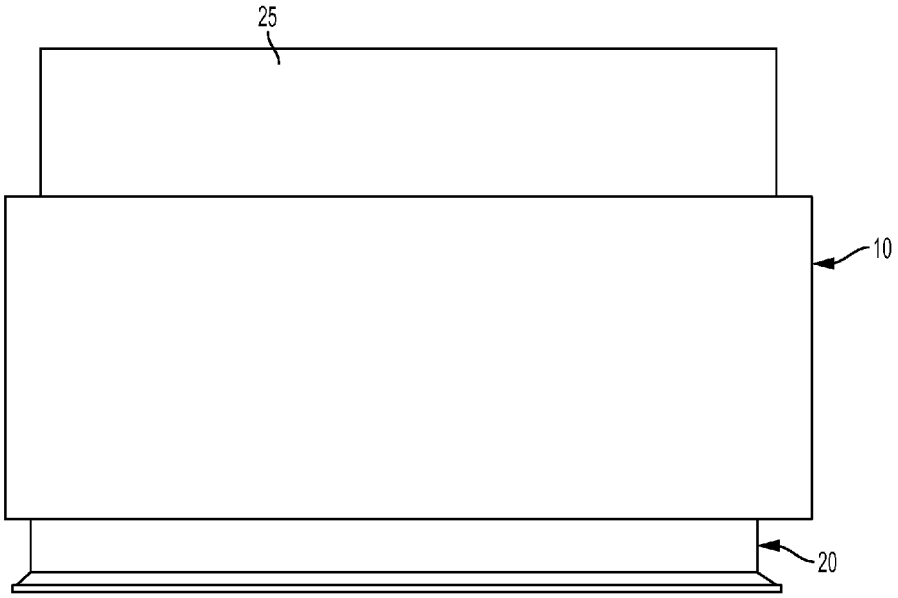
FIG. 7 shows a back elevation view of the view shown in FIG. 6.

FIG. 7 shows a back view of the weight bar body 10 and the adjustable blade 20. A screen segment 25 is shown attached to the upper portion of the blade bar body 10.

Figure 8:
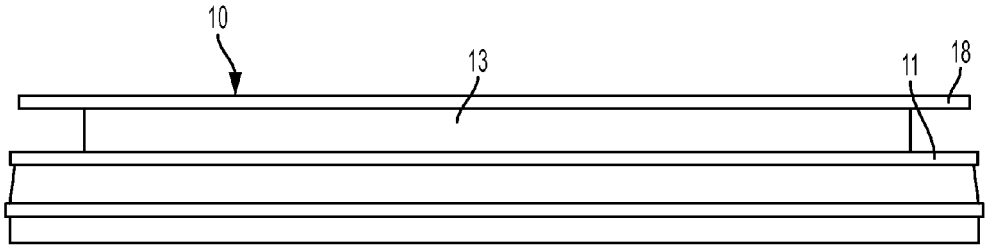
FIG. 8 shows a bottom plan view of the weight bar used in the present invention.

FIG. 8 shows a bottom view of the weight bar body 10 that includes the adjustable blade chamber 13 and the opening 18 along the base of the weight bar body 10.

Figure 9:
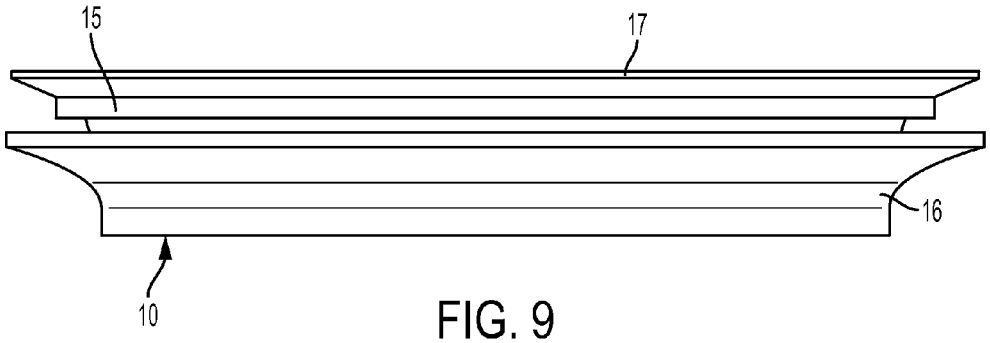
FIG. 9 shows a top plan view of the weight bar used in the present invention.

FIG. 9 shows a top view of the weight bar body 10 that includes a curved front portion 16 and exposing the hem chamber 15 in conjunction with the flange 17 mounted along the top of the weight bar body 10.

Figure 10:
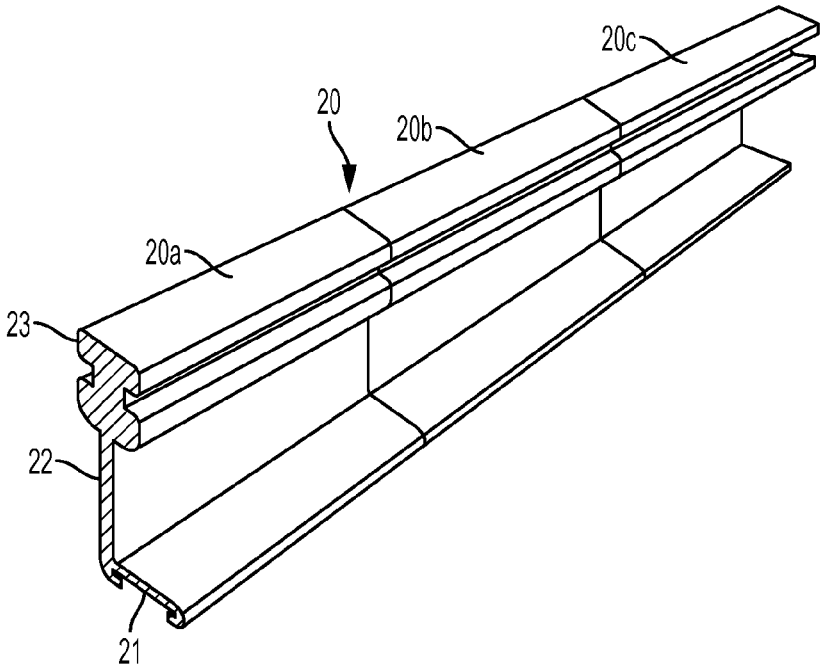
FIG. 10 shows a perspective view partially in cross-section of the self-adjusting blade used in the present invention that is mounted within the weight bar body when in use.

FIG. 10 shows a perspective view of an adjustable blade 20 used in the present invention. The blade body has a vertical wall portion 22 and an L-shaped flange 21 that can receive a weather strip or insect barrier that is attached in the slot 21. The adjustable blade guide 23 is an upper portion that is shaped to loosely fit within the blade retaining chamber in the weight bar body to allow free vertical and in the case of a segmented blade, some horizontal movement of the entire blade along its longitudinal axis and some front to back movement because of the overall cross-sectional shape of the guide 23 is smaller as compared to the cross-sectional shape of the blade chamber in the weight bar body is shown in FIGS. 1 through 4. The blade guide 23 keeps the individual segments from overlapping and in the same relative horizontal position without restricting each segment's vertical or tilting movements. The guide also allows each blade element to assume a fully extended position when the weight bar is raised giving a uniform horizontal appearance to the weight bar.

Alternative Embodiments of Invention

The weight bar body 10 is joined to the side tracks by means of guides that are attached to the weight chamber 12. The optional weight bar guides can be made of various materials and the dimensions are variable to match the side track vertical opening or vertical guide.

The self-adjusting blade 20 is optional and not required if the bottom surface is parallel to the weight bar body 10.

The self-adjusting blade 20 can be one segment or any number of individual segments. Multiple segments are used if the bottom floor surface is not on a continuous slope (such as a dip or hump somewhere between the two side tracks) where the slope actually runs in several directions. FIG. 10 shows blade 20 divided into three segments 20*a*, 20*b* and 20*c*.

Figure 11:
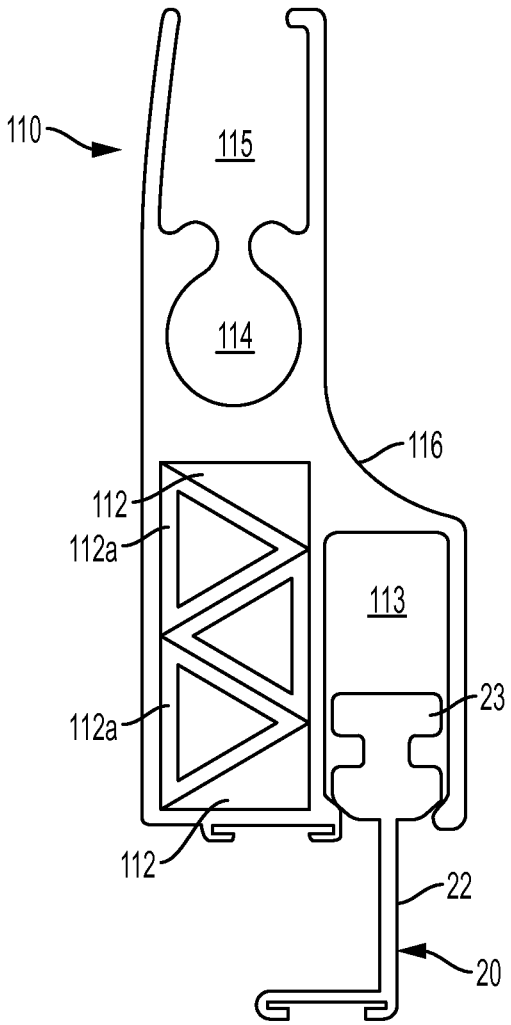
FIG. 11 shows a side elevation view of a weight bar body having a self-adjusting blade mounted therein that includes a weight chamber in accordance with an alternate embodiment of the invention.

FIG. 11 shows an alternate embodiment of the invention that has a modification to the weight bar body 110. Specifically the weight bar chamber 112 is modified to include structural walls 112*a* inside the weight bar chamber 112 that can be shaped in the form of triangles along the entire length of the weight bar body to improve the structural rigidity of the weight bar body and overall screen structure in operation. The triangular walls 112*a* can also be formed as a separate component enhance the rigidity and structural integrity to prevent bending or deformity of the weight bar body when in use.

Figure 12:
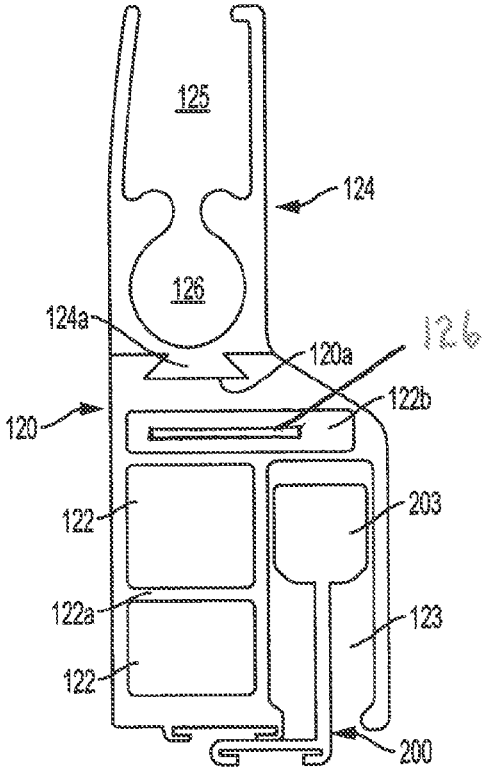
FIG. 12 shows a side elevation view of yet another alternate embodiment of the invention that includes the weight bar body that is attachable to a bottom member that connects to the bottom edge of the screen. The weight bar body includes a double weight bar chamber for strength longitudinally. It also includes a horizontal stiffening chamber in which a stiffener such as a metal bar can be placed to make the weight bar rigid and reduce the side bowing effects of external forces such as wind.

FIG. 12 shows yet another embodiment of the invention in which the structure of the weight bar body 120 has been changed. Specifically there are two weight bar chambers 122 separated by a wall 122*a* forming two different weight chambers 122. Again the horizontal wall 122*a* adds longitudinal structural integrity to prevent bending from wind on the screen as wall 122*a* extends the entire length (20 feet or more) of the weight bar body 120 preventing deformity. Also the adjustable blade 200 has been modified so that the guide 203 has a rectangular cross-section with curved edges for a lower overall profile. Another difference is that the lower section of the weight bar body 120 can be separated from an upper section 124 that includes the attachment chamber 126 and the hem chamber 125. A trapezoidal shaped flange 124*a* fits into a trapezoidal shaped slot 120*a* that allows the upper section 124 to be mated to the weight bar body 120 if necessary This allows for an unlimited number of attachment designs while maintaining the basic weight bar body design.

FIG. 12 shows an additional horizontal stiffening chamber 122*b*. Where the weight bar chamber 122 is used to customize the downward pressure on the screen, the stiffening chamber 122*b* is used to reduce the horizontal flex of the weight bar that often occurs due to wind pressure. The stiffening chamber will contain a non-flexing, stiffening device 126 such as a flat steel bar that is oriented such that the widest (least flexing) dimension is placed perpendicular to the vertical screen surface. This stiffening chamber allows for production of the main body from less rigid and less expensive materials while retaining the desirable overall weight bar characteristics. The stiffening device 126 is generally required on longer weight bars and not on shorter weight bars. The end of the stiffening chamber 122*b* will always be sealed with or without the stiffening device in place.

Figure 13:
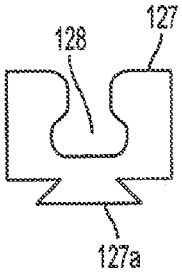
FIG. 13 shows a side elevation view of yet another alternate embodiment of the invention that attaches to the base of a screen bottom edge and also attaches to a weight bar body as shown in FIG. 12.

FIG. 13 shows yet another example of a screen/shutter connector 127 that can be used to be attached to a weight bar 120 shown in FIG. 12 using a trapezoidally shaped flange 127*a* female/male connector. This allows for various and unlimited types of screens, shutters and panels to be uniquely attached to a single designed weight bar body and blade arrangement or to be attached to just a weight bar body and weather strip.

Operation of Preferred Embodiment

To assemble: The weather strip is inserted into the weather strip holder 21. The self-adjusting blade 20 is inserted into the blade chamber 13. The determined amount of weight is inserted into the weight chamber 12 and the exposed ends are sealed (example: with caulking). The stiffening device 126 is inserted if required based upon the overall length of the weight bar (shorter weight bars may not require the stiffening element) and the stiffening chamber is sealed at both ends. The weight bar body 10 is oriented so that the curved brace 16 is facing towards the front of the screen or shutter.

The weight bar body 10 by means of the attachment chamber 14 is attached to the device in the manner suitable for that device. For example: it could be slid onto the matching bottom of the screen or shutter.

The track guides attached to the weight chamber 12 on both sides on both ends of the weight bar body 10 and optionally attached to the screen or shutter so that the weight is also transferred to the outside edge of the screen or shutter.

The assembled weight bar body 10 plus the self-adjusting blade 20 is now ready to be used after the entire device is attached to the top storage reel and the weight bar side guides are aligned to the side tracks or attached to the side guides. The orientation of the weight bar body 10 is to be located at the very bottom of the screen or shutter and extends the entire distance between the two vertical side tracks. The weight bar body 10 end guides will be engaged within the side tracks or guides to assist in keeping the weight bar body 10 evenly spaced from each track or guide; within the plane of the side tracks or guide and in a vertical orientation. The self-adjusting blade 20 hangs to its fullest extent below the blade chamber 13 until the weight bar body 10 has been lowered until the self-adjusting blade 20 makes contact with another surface such as a floor at which point the self-adjusting blades 20 retracts into the blade chamber 20 in such a way as to match the contoured plane of the (floor) surface that it is contacting. When the screen or shutter is raised vertically the elf-adjusting blades 20 returns to hanging at its fullest extent as the screen or shutter loses contact with the floor surface. The weight bar body 10 always remains in a horizontal orientation.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention in which all terms are meant in their broadest, reasonable sense unless otherwise indicated. Any headings utilized within the description are for convenience only and have no legal or limiting effect.

What is claimed is:

1. A device for eliminating open space between a bottom surface of a vertical screen system that rolls up and down for insect, solar, hurricane, security, and privacy protection and a non-level floor surface below the screen system bottom surface comprising:

a weight bar including a weight bar body having elongated rigid exterior wall surfaces that enclose a first longitudinal chamber extending from end to end and sized in cross-section to receive an elongated weight, said weight bar body rigid exterior wall surfaces also enclosing a second longitudinal chamber extending from end-to-end that has an open upper surface, said second longitudinal chamber being larger in diameter than said open upper surface and sized in diameter to receive a screen edge connector for receiving screen through said weight body open upper surface allowing said weight body to be attached to the bottom edge of the screen, said weight bar body including a blade retaining chamber extending from end to end of said weight bar body, said blade retaining chamber having a lower opening smaller than the area of the blade retaining chamber cross section;

a blade comprised of at least one segmented rigid elongated flat bar and a bottom edge, an elongated rigid flange attached on one side of the bottom edge of said flat bar including a pair of parallel slots for receiving a weather strip and attaching a weather strip to said blade along the bottom of said blade, said blade having an upper guide body extending its length attached to said flat bar, said blade upper guide body having a width larger than the opening in the weight body blade retaining chamber and smaller than the width of the weight body blade retaining chamber, said blade being encased and freely movably attached to said weight bar body allowing vertical and rotational movement between said blade and said weight bar enabling the blade to contort, extend and retract as required to match the lower surface contour.

2. A device as in claim 1, including:

multiple chambers for containment of variable customized weights, horizontal stiffening devices used to counteract horizontal deformation due to external sources and a containment area for segmented adjustable blades used to seal the lower edge of the weight bar.

3. A device as in claim 1, including:

a pliable weather strip connected to the bottom flange parallel slots of said blade.

4. A device as in claim 1 including:

said weight bar first chamber including at least one rigid wall connected to said to chamber sidewalls for reinforcing the weight bar longitudinally, said first chamber rigid wall dividing said first chamber into a pair of weight receiving chambers.

5. A device as in claim 1 including:

said weight bar first chamber having at least one array of triangular walls extending the length of the weight bar for reinforcing the structure of the weight bar to prevent further longitudinal bending or distortion.

6. A device as in claim 5, wherein:

said weight bar first chamber has an array of inserted triangular walls for reinforcement.

7. A device as in claim 5, wherein:

a stiffener;

said elongated horizontal stiffening chamber is positioned related to the weight bar with the least flexible, widest dimension oriented perpendicular to the vertical surface of the weight bar, said stiffener being designed to reduce horizontal weight bar bowing from an exerted, external horizontal force.

8. A device as in claim 1, wherein:

said blade is comprised of two or more vertical segments mounted side by side.

9. A device as in claim 1, wherein:

said upper attachment element used to affix to the bottom surface of the vertical screen being interchangeability attachable to the top of the weight bar body.

* * * * *